United States Patent [19]

Hundt

[11] Patent Number: 5,042,730

[45] Date of Patent: Aug. 27, 1991

[54] MULTI-PURPOSE ROTATING DISC SHREDDING DEVICE

[76] Inventor: Vincent G. Hundt, Rte. 1, Box 392, Coon Valley, Wis. 54623

[21] Appl. No.: 525,882

[22] Filed: May 17, 1990

[51] Int. Cl.[5] ..... B02C 18/22

[52] U.S. Cl. ..... 241/73; 241/79.1; 241/92; 241/101.2; 144/176

[58] Field of Search ..... 144/176; 241/73, 152 A, 241/92, 101.7, 101.2, 55, 56, 79.1, 101 R, 101.1

[56] References Cited

U.S. PATENT DOCUMENTS

| | | | |
|---|---|---|---|
| 2,146,074 | 2/1939 | Kelley | 241/92 X |
| 3,856,212 | 12/1974 | Swatko | 241/92 X |
| 4,346,744 | 8/1982 | Beer et al. | 241/92 X |
| 4,827,989 | 5/1989 | Strong | 241/92 X |
| 4,834,302 | 5/1989 | Baker | 241/92 |

FOREIGN PATENT DOCUMENTS

| | | | |
|---|---|---|---|
| 1561622 | 4/1970 | Fed. Rep. of Germany | 241/92 |
| 3612997 | 10/1987 | Fed. Rep. of Germany | 241/92 |
| 45164 | 3/1919 | Sweden | 241/92 |

*Primary Examiner*—Mark Rosenbaum

*Attorney, Agent, or Firm*—M. Paul Hendrickson

[57] ABSTRACT

The invention pertains to the conversion of rotating disc type wood chippers into a multi-purpose shredding device. Such wood chippers are typically equipped with a power driven rotating disc fitted with chipping knives mounted to the disc feed side and adjacent passageways thereto leading to the opposite disc side to a secondary processing chamber for the further processing of materials therewithin. By including channeling members about the passageways which alter the aerodynamics and material flow patterns on the disc feed side, buoyant feed materials (e.g. paper, plastic, etc.) can now be effectively processed with such wood chippers. A grating member can be placed at the material discharge to control the particle size of the discharged materials. An enclosed system fitted with a cyclone and agriculture baler permits the shredded materials to be continuously converted to small bales.

21 Claims, 5 Drawing Sheets

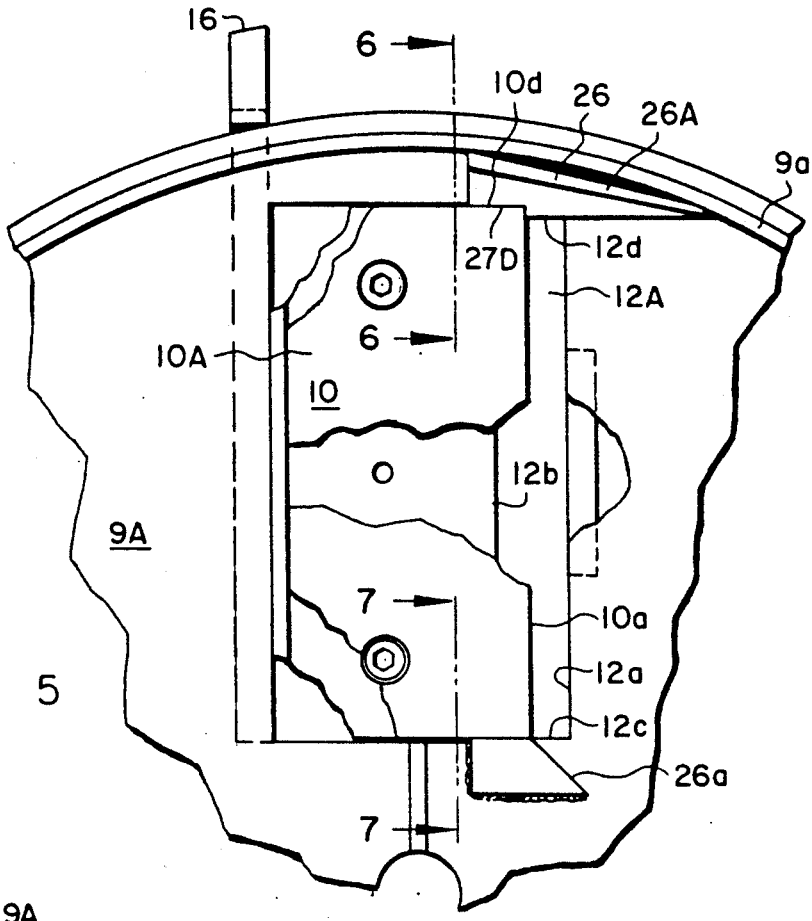
FIG. 5
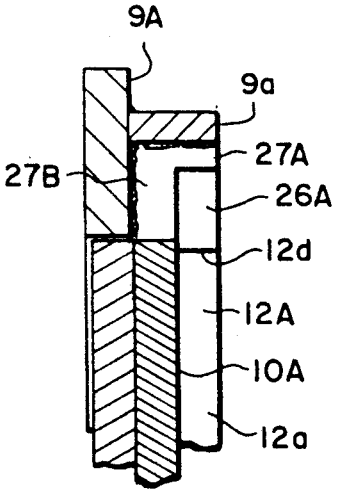
FIG 6
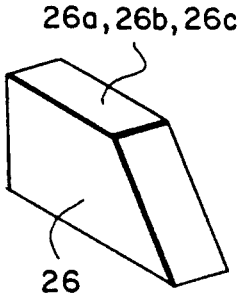
FIG. 9
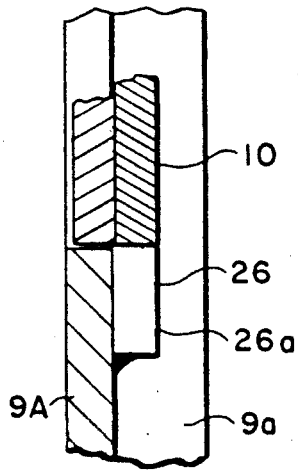
FIG. 7
FIG. 8
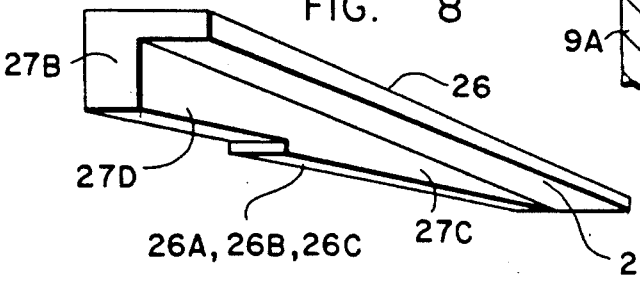

MULTI-PURPOSE ROTATING DISC SHREDDING DEVICE

FIELD OF THE INVENTION

This invention relates to shredding devices and processes and more particularly to devices having the capacity to continuously shred cellulosic and/or plastic materials.

BACKGROUND OF THE INVENTION

Shredding devices are used to shred cellulosic (e.g. wood, paper, etc.) and plastic materials at waste disposal reclamation or recycling sites. There are continuous and batch type shredders. Continuous shredding devices are adapted to continuously receive a feed material and exhaust shredded material. The continuous shredding devices are generally capable of handling large volumes of feed materials. In contrast, batch or non-continuous shredding devices process the material on a batch-wise basis until the desired shred at which point the shredded material is dumped and a fresh batch of unshredded material is added to the shredder.

Low cost shredding devices which rely upon an initial cutting or shearing stage followed by a secondary shredding stage are commercially available. These shredding devices are generally limited in material handling capability or shredding applicability. Devices useful for shredding paper products are often unfit for shredding wood or plastic materials and vice versa. Certain inexpensive paper shredding devices shred paper into elongated strips which, although useful for the destruction of confidential or business documents, such shredded products are nominal in value.

In contrast to the aforementioned devices which initiate waste material processing by cutting, certain devices which rely upon initially grinding or crushing a wide variety of materials such as plastics, wood, paper, rock metal, coal, limestone, etc. Such devices are prohibitively expensive and are restricted to large recycling or reclamation sites having a sufficient abundance of waste materials (e.g. such as may be obtained through waste collection and disposal in the large metropolitan areas) to override the expenses. It is not economically feasible to utilize these devices at suburban, rural or small town waste recycling or reclamation sites which are not in close proximity to a large metropolitan area or an otherwise abundant source of waste materials.

Large paper reclamation or disposal sites may also combine their paper shredding operation with baling devices which bale shredded paper into a large bale size (e.g. ½ ton size or larger) for resale primarily to paper manufacturers. The supply of such shredded products exceeds the demand. Consequently, there exists marginal profits for such shredded paper producers.

There currently exists a substantial demand for bedding (e.g. straw, chopped corn stocks, saw dust, etc.) within the livestock and poultry producer trade. Paper shredded to the proper bedding size (at an attractive processing cost in close proximity to such livestock and poultry producers) would alleviate a substantial waste disposal problem and significantly enhance the waste paper recycling profitability. More profitable margins would arise if it were possible to convert such paper products into a functional and useful bedding form at the smaller and more rural processing sites via inexpensive equipment possessing multi-waste material processing efficacy.

The patent literature discloses numerous shredding devices. Illustrative thereof is U.S. Pat. No. 4,350,308 to Brewer which discloses a shredding machine for mounting to a revolving shaft, a blade-holder with a radially outwardly projecting protuberance having a forwardly-facing blade-backing surface, a slot having opposed surfaces, a blade seated in the slot engaging said opposed surfaces and disposed against said blade-backing surface, wherein said blade has a work-impact forward surface positioned above said slot, and elongate securement means disposed above and outside said slot and projecting through said blade, and into said protuberance.

U.S. Pat. No. 4,850,408 to Carpenter et al discloses a wood chipper apparatus having a rotating chipper disc and one or more knives mounted on said disc to produce wood chips upon feeding wood material against the disc.

U.S. Pat. No. 4,706,898 to Schonfeld et al discloses a crushing machine with a removable outlet grate, wherein the outlet grate is disposed between the crushing machine housing extending horizontally between a pair of opposite walls, and an opening is provided in at least one of the opposite walls in the vicinity of the rate, to enable said grate to be removed in whole or in part through the opening.

Other illustrative patents of interest which appertain to particle reduction devices include: U.S. Pat. No. 1,921,914 to Edman; U.S. Pat. No. 3,561,685 to Feder; U.S. Pat. No. 4,071,198 to Tetreault; U.S. Pat. No. 4,168,035 to Palm et al; U.S. Pat. No. 4,422,353 to Hull et al; and U.S. Pat. No. 4,736,781 to Morey et al.

Wood chipping devices of a rotating disc type are known. Devices such as the Eklund et al wood chipper (see U.S. Pat. No. 3,384,311), the aforementioned Carpenter et al device (U.S. Pat. No. 4,850,408), the Valby wood chippers and other similar type chippers characteristically rely upon rotating knives affixed onto a rotating disc having passageways through which the chipped wood pieces from the knives are transferred through the passageways into a secondary processing chamber for further processing. These devices are relatively inexpensive and commonly used by governmental units and private industry in the disposal of wood trimmings.

SUMMARY OF THE INVENTION

The present invention affords a process and shredding device of general applicability for converting cellulosic and plastic materials (e.g. on a large volume basis) and other common waste materials into a more functional and resalable products at a relatively inexpensive capital investment and manufacturing cost. Relatively inexpensive wood chipping devices of the rotating disc type can now be converted pursuant to this invention into a device which produces shredded paper and plastic materials as well as chipped woods. This conversion generally applies to wood chipping devices of the type equipped with a material feed, a rotating disc having one or more angular knives mounted at one side of the disc and extending outwardly from the disc for cutting or chipping a feed material, passageways adjacent to the knives which communicate to the opposite side of the disc so as to allow the cut or chipped material of the knives to pass therethrough into a secondary processing chamber whereupon the cut or chipped material is subjected to further processing to cause a further reduction in particle size of the cut or chipped material therewithin and a discharge outlet for discharging the processed material therefrom.

Such wood chipping devices when converted to include means for directionally channeling the knife chipped or cut material onto the communicating passageways within the rotating disc become highly effective shredding devices for the processing of the more buoyant aerodynamic and pliable materials such as plastic and/or paper materials. The placement of an arcuate rated screen at the discharge outlet also allows for more effective processing of the materials and particle size control. The embodiments of this invention provide a means for converting relatively inexpensive wood chippers into a device and process for multiple material adaptation, such as for wood, paper, plastic and other waste handling capabilities. This permits the smaller waste reclamation and recycling sites to economically produce commercially recyclable shredded paper and/or plastics products without detracting from the wood chipping efficacy of the device.

The shredding process of this invention further provides a unique method and equipment for effectively baling the shredded materials of the modified wood chipper into a baled product of a manual handling size. This may be accomplished within an enclosed system by reducing the air velocity of the exhausted material (e.g. reducing velocity of the air blown material such as a cyclone separation treatment) so that it may be fed into the feeding mechanism of a modified conventional agriculture baler adapted to receive and bale the shredded material into a smaller than conventional paper bale size.

BRIEF DESCRIPTION OF THE DRAWINGS

FIG. 5 is an enlarged sectional view of FIG. 2 which shows in greater detail the channeling member embodiments of this invention.

FIG. 6 is a cross-sectional view taken along line 6—6 of FIG. 5.

FIG. 7 is a cross-sectional view taken along line 7—7 of FIG. 5.

FIG. 8 shows an enlarged view of the channeling member shown in FIG. 5.

FIG. 9 shows an enlarged view of another channeling member shown in FIG. 5.

DETAILED DESCRIPTION OF THE INVENTION AND ITS PREFERRED EMBODIMENTS

The present invention is directed towards a process for preparing shredded materials and the equipment therefore. The process and equipment is particularly well adapted for converting wood chippers of the rotating disc type into a device which also inexpensively processes buoyant waste materials such as plastic and paper products into a more useful and functional form.

Figure 1:
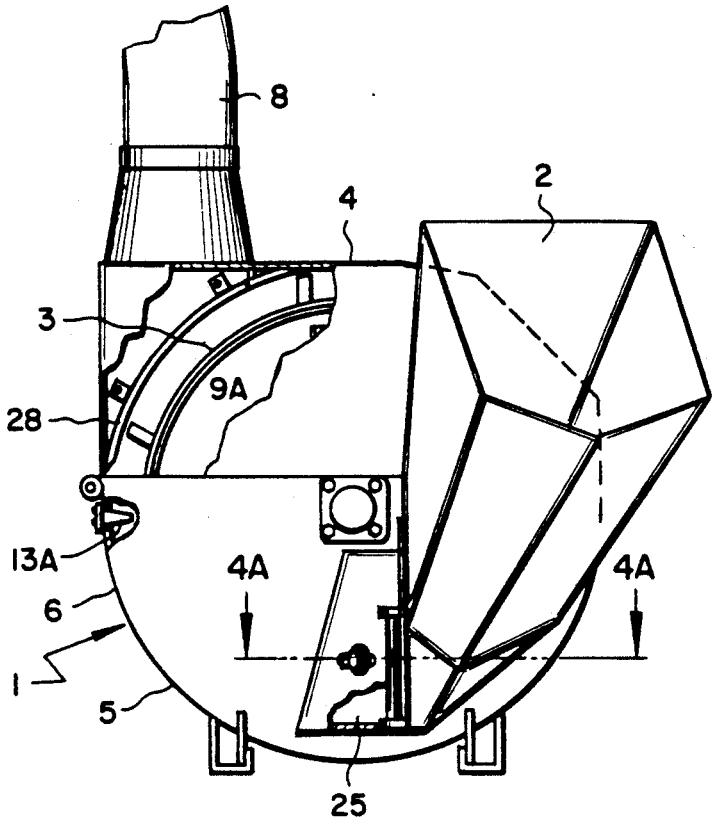
FIG. 1 depicts an external feed side view of a rotating chipper disc type device internally equipped (as shown in part by break-away view thereof) with the necessary internal working components to effectively process cellulosic and plastic materials into a functionally useful recycled product.

FIG. 1 depicts an external view of a wood chipping device within which the internal working components (shown in part) have been modified so as to effectively and continuously shred both paper and plastic products as well as chip wood. The device (generally designated as ) includes a material feed hopper 2, a rotating disc (shown in part and designated herein as 9A) fitted with means for initially cutting a feed material at anvil 25 a secondary processing chamber (generally designated herein as 3, the internal workings of which are occluded from the FIG. 1 view, but shown in FIGS. 2-5), an outer housing 4 (shown as being comprised of an arcuate wall 5 and sidewalls 6) which serves to house disc 9A and the secondary processing chamber, a tangentially discharge outlet (generally designated as spout 8) for discharging or exhausting the processed materials and a suitable power source for powering the device. As will later be explained in greater detail, FIG. 1 also reveals a removable grated screen 28 which has been particularly useful when applied to the processing of plastic and cellulosic waste products into a more functional, profitable, transportable and marketable recycled product form.

Wood chipping devices of this type bear in common a rotating disc fitted with cutting knives on the feed side and passageways for transferring the cut material from feed side of the disc to the other disc side into a curvilinear processing chamber which may effectuate a further particle reduction in the cut material. The direction of rotation, the number of knives and passageways, the particular manner whereby the secondary processing chamber effectuates a reduction in particle size may vary between the different types of wood chipping devices of the rotating disc type. Exemplary wood chippers of this type include the wood chipper disclosed in U.S. Pat. No. 3,384,311 by Eklund et al, U.S. Pat. No. 4,850,408 by Carpenter et al and VALBY wood chippers, the latter of which is described in greater detail hereinafter. Exemplary thereof are the Valby wood chippers (e.g. Models CH231, CH231SS and CH231OEM), which are limited in adaptation for chipping wood (logs, branches, etc.) into various wood chip sizes(e.g. ¼' size for animal bedding, ½' as an energy chip, ¾' as a wood pulp chip and a 1' chip for landscaping purposes) by adjusting the cutting knives to an appropriate cutting depth. Such rotating disc type wood chippers may be adapted for mounting onto the three point hitches and powered by the power take off drives of conventional tractors or powered by stationary power sources such as electrical or fuel driven motors as illustrated.

With reference to the Figures, such power driven wood chippers typically include a power driven shaft 11 rotatably supported about a common fixed axis such as by a pair of bearing members (not shown) secured to a suitable support frame (not shown) at opposite ends of drive shaft 11, a rotary disc 9A mounted to shaft 11 for rotation therewith, one or more angularly projecting knives (generally prefixed by 10) mounted upon the face or feed side of the disc 9A, one or more passageway (generally prefixed by 12) adjacently positioned upon the feed side of disc 9A to each knife 10 (in a laterally disposed relationship therebetween) which form an internal passageway through disc 9A whereby the wood cut into chips or otherwise cut material by the knives 10 are allowed to pass to the opposite side of disc 9A.

More specifically the particular device illustrated in the Figures typifies a VALBY wood chipper which is equipped with a pair of parallel and laterally disposed discs 9A and 9B (depicted in FIGS. 3, 4, and 4A) which rotate about a fixed axis (i.e. shaft 11) driven by a Common power source. Disc 9A interfaces onto the feed spout 2 and includes three angularly cutting knives (10A, 10B and 10C) facing outwardly and inclined towards the rotational direction of disc 9A and three passageways 12A, 12B and 12C), respectively adjacently positioned beneath the inclined cutting planes of knives (10A, 10B and 10C) so as to form internal passageways leading from the feed side to the opposite side of disc 9A.

Cutting knives 10A, 10B and 10C are illustrated as being of a rectangular shape (albeit knives 10 of other configuration, shapes and sizes will apply) the bordering edges of which may be defined as a cutting edge (designated as **10*a* for knives 10A, 10B and 10C), a rearward edge (designated as 10*b* for knives 10A, 10B and 10C), a proximate edge (designated as 10*c* for all depicted knives) and a distal edge (designated as 10*d*). The distal edge 10*d* and proximate edge 10*c* are respectively designed to mate onto a rearwardly portion of a distal passageway bordering edge (designated in all cases as 12*d*) and a proximate passageway bordering edge (designated as 12*c* in all cases) with the rearward knife edge 10*b* of knives 10A, 10B, and 10C projecting upwardly and outwardly therefrom at an inclined plane to the cutting edge 10*a* respectively disposed at a lateral position to passageways 12A, 12B and 12C**.

Figure 2:
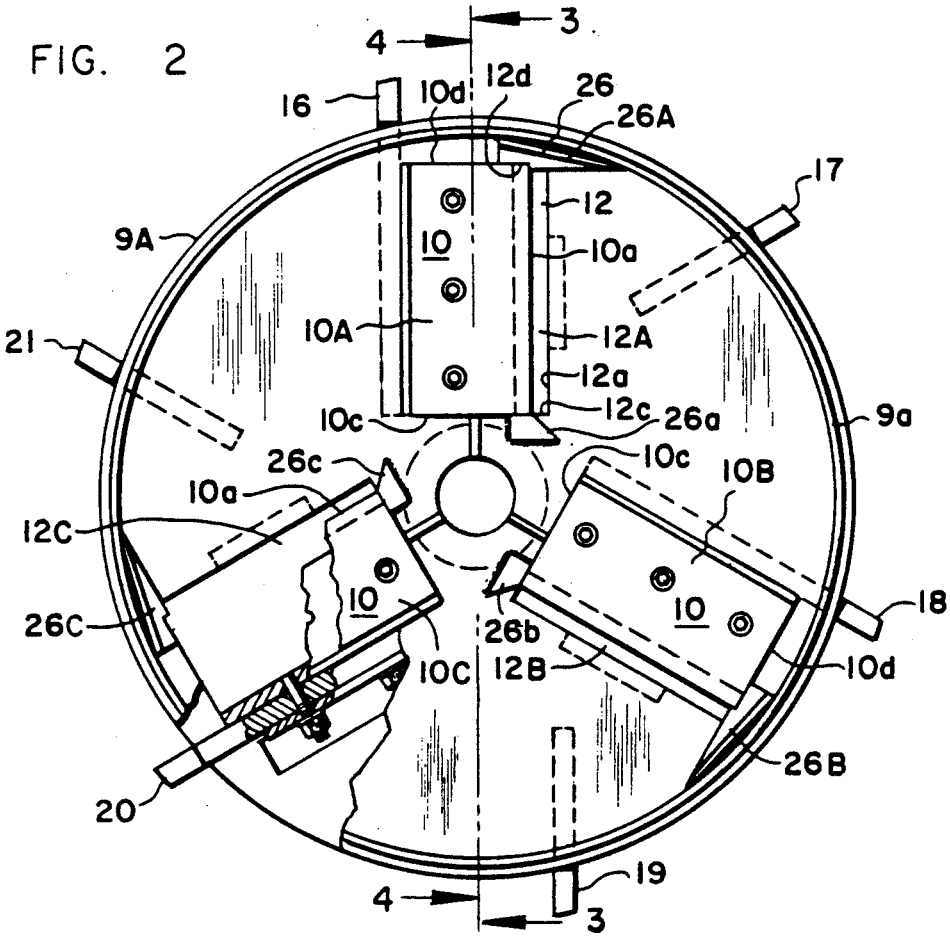
FIG. 2 is a frontal view of the feed side of rotating disc shown in part in FIG. 1 which reveals the channeling member embodiments of this invention.
Figure 3:
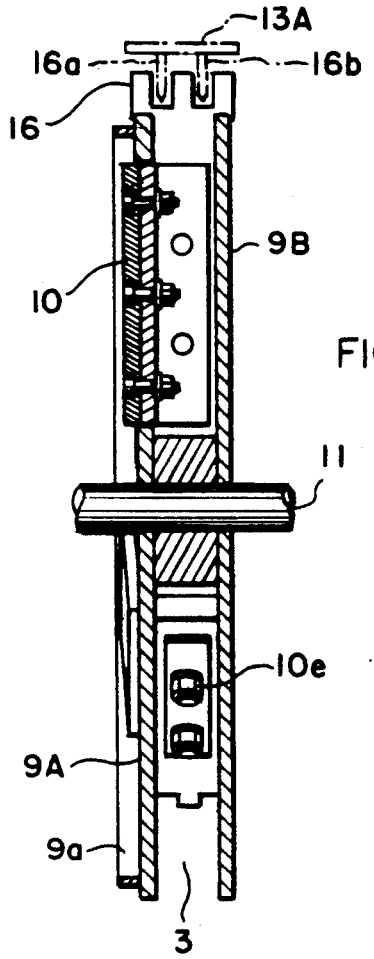
FIG. 3 is a cross-sectional view of the rotating disc of FIG. 2 taken along line 3—3.
Figure 4:
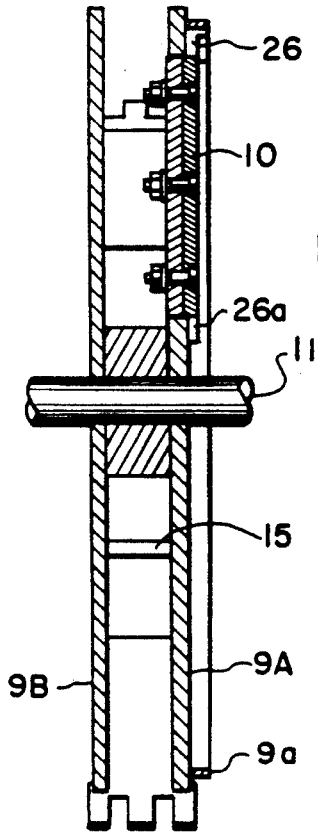
FIG. 4 is a cross-sectional view of the rotating disc taken along line 4—4 of FIG. 1.
Figure 4A:
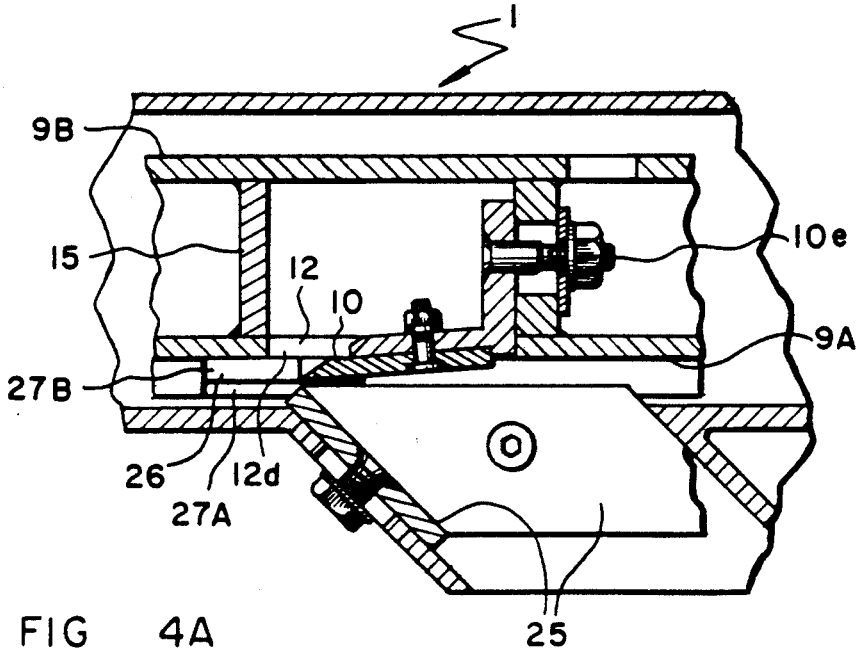
FIG. 4A is a cross-sectional view of the device taken along line 4A—4A of FIG. 1.

As will be observed from FIGS. 3 and 4, disc 9A is laterally paired onto disc 9B, the combination of which provides a hollowed processing or cavity region within which material passing through passageways 12A, 12B and 12C are fed. Disc 9B is a solid disc of a mating size and configuration to Disc 9A, but without passageways 12 of disc 9A. Discs 9A and 9B are spaced apart and secured together (e.g. welded) by radially extending spacing members (shown in part, and generally designated in the Figures as 15) positioned at equidistant radii sites, each of which is radially terminated by a serrated paddle-shaped protruding member (respectively identified as 16, 17, 18, 19, 20 and 21) which extend beyond the outer periphery of discs 9A and 9B. The region bounded between the discs 9A and 9B and the arcuate zone housed within outer housing 4 primarily forms secondary processing chamber 3 Wherein the cut material feed thereto by passageways 12 is further processed thereby. Spacing members 15 and their respective paddle-shaped protruding members 16–21 (upon locomotion) serve as a means for propelling the cut material through the secondary processing chamber 3. Each of the paddle-shaped members 16–21 include a pair of serrated slots (shown in part by FIG. 3 with reference to paddle-shaped member 16 and designated therein as **16*a* and 16*b*) which bear corresponding lateral registration for passage through a pair of stationary shearing members (one of which is shown as 13A) mounted externally to the rotating discs 9A and 9B. One of the stationary shearing members immediately precedes screen 28 on its feed side and the other stationary shearing member being about 180 degrees therefrom. The serrated paddle-shaped members (16–21) follow a fixed orbital pathway for lateral traversal through the vectors or sectors (spaced apart by about 60 degrees) served by the stationary shearing members (frequently referenced in the art as recutting knives). The secondary processing (namely shredding of the cut paper or plastic material) arises upon impingement, the shearing and shredding co-action of the serrated paddles 16–21 and stationary members upon the material. Accordingly, each of the serrated paddle members (16–21) upon rotation will pass through the shredding sector served by each of the stationary shearing members (as illustrated by phantom 13A depiction of FIG. 3) and effectuate a concomitant shredding (e.g. recutting) effect upon the material thereby. The particular disc 9A which interfaces onto the material feed side of the device is shown as being equipped with three passageways (e.g. shown as rectangular shaped apertures 12A, 12B and 12C, each measuring about 11.8 inches by about 2.5 inches in size) radially spaced apart at 120 degrees from one another. Similar to the knives 10A, 10B and 10C, the bordering edge which define the periphery boundary of the passageways 12A, 12B and 12C (e.g. see in particular the break-away view of FIG. 2 about knife 10*b*) may be defined as a forward passageway bordering margin (designated in all cases as 12*a*), a rearward passageway bordering margin (designated in all cases as 10*b*), a proximate passageway bordering margin (designated in all cases as 12*c*) and a distal passageway bordering margin (designated in all cases as 12*d*) which collectively define the bordering edges or margins of passageways 12A, 12B and 12C to disc 9A. Passageways 12A, 12B and 12C typically bear substantial correspondent registration to the shape, size and configuration to the respective knives adjacently positioned thereto. It will also be observed that the cutting knives 10A, 10B and 10C form an acute angle to each of their respective passageways 12A, 12B and 12C (in relation to the plane across the face of passageways 12 on the feed side of disc 9A) with knives 10 being vectored onto rear margin 12*b* of passageways 12 and incline outwardly therefrom so as to form a closure along said rear margin 12*a* leaving with an open zone existing between the feed side surface of the disc 9A and knives 10 about the distal margin 12*d*, forward margin 12*a* and proximate margin 12*c*. As will be explained in greater detail later, this open zone (particularly along the distal margin 12*a*) of passageways 12** makes it impossible to process buoyant and/or pliable materials with devices of the aforementioned wood chipping type.

Cutting knives (10A, 10B and 10C) are angularly mounted to disc 9A towards the material feed side of disc 9A with means to variable adjust the depth of cut. The outermost distance from the cutting knives 10 and the feed surface of disc 9A (i.e. lateral distance from knife cutting edge **10*a* to disc surface on feed side) will generally regulate the transverse depth of cut. By adjusting the spatial distance between the outermost cutting edges (through adjustments via bolt adjusters 10***e*) of knives (10A, 10B and 10C) the material feed depth of cut can be adjustably regulated. This arrangement is somewhat analogous to an adjustable hand planer in which the planed wood is forced through an aperture of the plane in the form of wood shavings. The density of the wood cut and chipped by knives 10A, 10B and 10C in combination with the angular placement of the knives at the rearward rotational edge of the corresponding registering passageways 12A, 12B and 12C allows the wood chips to pass through the passageways onto the opposite side of disc 9A.

An adjustable anvil 25 (shown in FIG. 1 near the bottom of the feed chute 2 and in more detail in FIG. 4A) stationarily positioned along the rotational orbital path of knives 10 in cooperative association with the cutting knives 10A, 10B and 10C rotating in a clockwise manner about the axial shaft 11 serves as an anvil for holding and initially cutting the feed material.

Such rotating disc wood chipping devices (without the channeling member embodiments of this invention) are specifically designed and limited to serve solely as wood chipping devices. They are unfit for handling either paper or plastic materials or other similar aerodynamically influenced or pliable materials. The material flow and turbulent air conditions about the passageways 12A, 12B and 12C and knives 10A, 10B and 10C render such wood chipping devices unfit for handling lightweight feed materials such as plastic or paper, as well as other pliable materials. Early experimental attempts (by the inventor) to process buoyant and/or pliable materials revealed an excessive feed material build-up about the face or feed side of disc 9A and especially about the distal edge 10*d* of cutting knives 10A, 10B and 10C. This resulted in substantial material compaction and clogging upon the feed side of disc 9A. The problem was further compounded by the frictional forces exerted upon the compacted material and heat generated thereby which in turn caused melting (particularly in the case of thermoplastics) or charring (e.g. paper) which if operationally prolonged would ultimately lead to combustion of the materials. A similar problem has been observed to arise in attempts to handle pliable wood products such as twigs, branches, etc.

Multiple material handling capability for rotating disc chippers of this type may be accomplished by incorporating therewithin means for directionally channeling the material feed onto knives 10 and through the passageways 12 to the opposite side of the disc 9A. The directionally channeling embodiments of this invention effectively alters the feed and aerodynamic patterns and material flow about passageways 12A, 12B and 12C and the orbiting knives 10A, 10B and 10C so that these rotating disc type wood chippers may now be effectively utilized to process such buoyant and pliable materials.

With particular reference to FIGS. 2–9, the means for directionally channeling (generally prefixed by 26) the feed materials onto the cutting edges 10*a* of knives 10A, 10B and 10C and passageways 12A, 12B and 12C is shown. The illustrated directional channeling means (generally prefixed as 26) of primary concern includes wedge-shaped channeling members 26A, 26B and 26C which are secured (e.g. welding, bolting, etc.) onto the feed side of disc 9A between the passageways 12A, 12B and 12C and rim 9*a*. Channeling members 26A, 26B and 26C are respectively shown as projecting forwardly from the cutting plane of cutting edge 10*a* of knives 10A, 10B and 10C and their correspondent passageways 12. Channel members 26A, 26B and 26C are also depicted as abutting onto the flanged rim portion 9*a* of disc 9A with the rearward portions forming a bridging between rim 9*a* and distal edge 10*d* of cutting knives 10A, 10B and 10C. In operation, the wedge-shaped channeling members (26A, 26B and 26C) in cooperative association with rim portion 9*a*, the facing of disc 9A and knives 10A, 10B and 10C effectively serve to sweep and redirect the feed material and air currents preceding and about cutting edges 10*a* towards a more centrally disposed zone of cutting knives (10) and passageways 12. The outer rimmed portion 9*a* in combination with channeling members 26A, 26B and 26C redirects and creates air eddies for material movement proceeding the leading cutting edges 10*a* of knives 10 towards knives 10 and their respective correspondent passageways 12. This directional sweeping effect in combination with air currents generated from within the secondary processing chamber 3 is also believed to create a Venturi effect for effectively redirecting and drawing such more aerodynamic buoyant materials as cut by knives 10 through passageways 12 into the secondary processing chamber 3.

The predominant air current movement radiates away from the axis of shaft 11 towards outer periphery or parameter of disc 9A. The configuration of wedges 26A, 26B and 26C are thus specifically designed to channel and sweep such air borne and other materials (at high air borne speed) inwardly and away from rim 9*a* and onto passageways 12A, 12B and 12C. Although the teachings herein may be occasionally referenced to channeling member 26A, such teachings also apply to channeling members 26B and 26C. The build-up, clogging and combustion of buoyant and pliable materials (e.g. plastics, paper, pliable twigs, branches, etc.) about the outer peripheral margin of disc 9A (i.e. zone from knife distal edge onto rim 9*a*) and those corresponding regions margining onto the passageways 12A, 12B and 12C and knives 10A, 10B and 10C are effectively alleviated by channeling members 26A, 26B and 26C. The wedge-shaped channeling members 26A, 26B and 26C effectively prevent light weighted as well as pliable materials (e.g. plastic and/or paper) from collecting and building up along a radial plane extending outwardly from the distal edges (10*d*) of knives 10A, 10B and 10C to rim 9*a*. The wedge-shaped channeling members 26A, 26B and 26C thus eliminate excessive cut feed material accumulation about the peripheral zone and effectively sweep the cut feed material into the respective rectangular shaped apertures of passageways 12A, 12B and 12C.

As shown in greater detail in FIG. 5, the radially outwardly most disposed cornered edges of wedge 26A (i.e. its forwardmost and rearward points of its outer edge) rests substantially flushly onto rim 9*a* with the edges of wedge 26A sectoring a chorded portion thereof which in relation to the plane of cutting edge 10*a* extends along a rearwardly position thereto to a forwardly positioned site thereto. The cavity region between rim 9*a* and wedge 26A may be appropriately filled such as by a welding it closed. The leading edge of wedge-shaped member 26A is also shown as contouring smoothly onto disc 9A at a sufficiently forward site from cutting edge 10*a* so as to sweep the material mass away from rim 9*a* towards passageway 12A. Channeling members 26A, 26B and 26C are also flighted so that in relation to the face of disc 9A, the Channel members 26A, 26B and 26C bear a higher elevation towards rim 9*a* than do the passageway distal margin 12*d*. The lower flight and inner portion (designated as 27A) of wedge 26A is shown as declining and extending to a site substantially forward of the cutting edge 10*a* and the forward passageway margin 12*a*. The outermost portion of the inner portion 27A of wedge 26A rests in substantial alignment with distal edge 10*a* of knife 10A.

The multi-planar configuration of the preferred wedge as shown (e.g. particularly depicted in FIGS. 5 and 8) not only serves to directionally channel the air currents and feed materials into and through the passageways 12, but also serve as a barricading member for preventing the flow of material past the cornering edge of the distal edge 10*d* and cutting edge 10*a* of cutting knives 10. This barricading effect is particularly important as knives 10A, 10B and 10C orbitally pass through the cutting sector of anvil 25. The inner portion 27A of wedge 26A allows anvil 25 to clear wedge 26A while also serving to prevent the cut feed material from building-up about the distal knife edge 10*d*. The inner portion 27A in relation to its orbital passage about anvil 25 is designed to prevent the feed material escaping passage through passageways 12. It also serves to cause shearing of material as knives 10 sweep past the anvil 25 surface. It should be noted that the inner portion 27A of wedge 26A (as well as for wedges 26B and 26C) is designed to fit beneath the bordering margin of the distal edge 10*d* of knife 10A and cuttingly engage onto anvil 25 at a clearance sufficient to substantially inhibit movement of feed material past passageways 12.

Channeling members 26A, 26B and 26C also include a ramped portion (generally designated as 27B) of a multi-ramp configuration comprised of a forward ramped section 27C and a rearward ramped section 27D. The inner portion 27 is ramped at about 5 degrees, the forward ramp 27C at about 11 degrees, and the rearward ramp 27D at about 9 degrees. The depicted channeling members 26A, 26B and 26C as described above, is specifically adapted for use in a knife blade 10 projecting outwardly from the face of disc 9A (at its distal cutting edge 10*d*) at a distance Of about 9/16 of an inch. As shown in FIG. 5, the distal edge 10*d* of knife 10 is nestled flushly against and onto the ramped portion of rearward ramped section 27D to its juncture to the forwardmost ramped section 27C at which point the cutting edge 10*a* of knife 10A abuttingly aligns onto the rear margin of forward ramped section 27C. The illustrated channeling member 26A, 26B and 26C may be fabricated to a size measuring approximately 11.3 centimeters (cm) in length and 30 millimeters (mm) in width with both the inner portion 27B and the ramped portion thereof measuring 15 mm each in width, and the forward ramped section 27C measures about 70 mm and the rearward ramped section 27D about 43 mm. This particular configuration has been found to be effective for use with the cutting knives set at about a 9/15 inch clearance. It is also important to note the illustrated channel member 26 forms a barricading enclosure about the open zone between knife 10 and the distal margin 12*d* of passageway 12 as well as the plane which extends outwardly from and between cutting edge 10*e* to rim 9*a*, and anvil 25 as knives 10 pass therethrough. If different cutting depths are desired, attachable and detachable wedges 26A, 26B and 26C may be flighted at varying heights to accommodate for the anvil 25 and knife 10 clearance. Precautions, however, should be taken in such accommodations to maintain a sealed relationship and to prevent material build-up about the distal knife edge 10*d* and excessive sweeping of material past the passageways 12 as the cutting edges 10*a* pass through the anvil 25 cutting sector.

A substantial amount of friction and concomitant heat is developed by the material being cut at the anvil 25 and knife 10 junctures. The leading edges of the channeling members 26A, 26B and 26C rests sufficiently forward from the cutting edges of 10*a* (e.g. at about 2 ¼ inches ) of knives 10A, 10B and 10C to allow for heat dissipation therefrom with the confluent design thereof channeling the feed material onto knives 10A, 10B and 10C.

The proximate edges (designated as 10*c*) of knives 10A, 10B and 10C and the correspondent proximate margin 12*c* of passageway 12 are also preferably correspondly fitted with inner channeling members 26*a*, 26*b* and 26*c* secured (e.g. welded, bolted, etc.) to disc 9A. These inner members may likewise, if desired, mirror the beveled configurations of channel members 26A, 26B and 26C. Since the centrifugal forces generated by the shredding device tend to force the feed material towards the outer periphery of disc 9A, the inner channeling members 26*a*, 26*b* and 26*c* are not essential but represent a preferred embodiment of the invention. The inner channeling members 26*a*, 26*b* and 26*c* do not necessitate clearance for the anvil and therefore are shown as having a flat surfaced contour as opposed to the multi-planar beveled construction of wedges 26A, 26B and 26C. With particular reference to FIGS. 2 and 9, the inner channeling member: 26*a*, 26*b* and 26*c* are mounted onto the face of disc 9A as to project forwardly from the cutting plane of cutting edges 10*d* and onto proximate knife edge 10*c* so as to sweep materials toward the cutting knife.

The aforementioned channeling means allow for effective conversion of rotating disc and passageway wood chippers into a multi-shredding device having the capability to shred paper and plastic feed materials as well as to chip wood materials. Materials cut by the primary cutting action of knives 10A, 10B and 10C and anvil 25 are thereby effectively and directionally swept through the apertured passageways 12A, 12B and 12C into the material handling cavity disposed between discs 9A and 9B.

The efficacy of the device in shredding plastics and, if desired, smaller sized shredded paper or other materials may be significantly enhanced by incorporating a grated screen (generally designated as 28) at the discharge side of the secondary processing chamber 3. The grated screen 28 is preferably of an arcuate configuration substantially of the same contour and curvature as the inner periphery of housing 4 as depicted by the cross-sectional FIG. 3 view. Grated screen 28 may be suitably tangentially positioned along the orbital margin of paddle members 16–21 at the discharge outlet 8. The grated screen 28 preferably includes means for its detachment or mounting onto the device (shown as four mounting brackets 28A, 28B, 28C and 28D) which correspondly register onto screen mounting brackets (not shown, for securance thereto by screen mounting bolts and nuts or any other suitable fastening means) within housing member in proximity of the tangential discharge as shown in FIGS. 1 so as to permit its mounting when needed (e.g. for plastic shredding) or its removable when not needed such as for chipping wood or shredding paper. Grated screen 28 is preferably of a durable construction (e.g. ⅜' steel plate) so as to withstand the rigorous impacting of materials thereupon. The forward or leading edge of grated screen 28 (e.g. see FIGS. 10–11) is preferably beveled so as to smoothly contour onto the interior arcuate surface of housing 4 and allow the shredded material to move smoothly across its face. The grate 28 is provided with a plurality of grating apertures (designated as 28*a*) which are also preferably of a design and configuration so as to directionally receive and in co-action with the centrifugal force of the propelled material and serrated paddles 16–21 effectuate additional shredding of the material prior to its discharge through spout 8. This may be more effectively accomplished by slanting the leading or receiving edge of each aperture 28*a* towards the material feed side (i.e. the initial approach side of paddles 16–21) with the opposite side therefrom (i.e. outwardly towards the exit side of grated screen 8) being further removed or receded therefrom. It will accordingly be observed from FIGS. 10 and 11, that the aperture opening 28*a* interfacing onto the feed input side of grated screen 28 are slanted towards the feed input while the aperture openings 28*a* on the screen discharge side are recedingly removed therefrom by means of about a 45 degree slant cutting of apertures 28*a* which in turn positions the slant of the aperture edges in parallel alignment with the material flow through discharge chute 8. Although the slanted apertures are shown as being of a hexagonal shape other slanted apertures shapes (e.g. polyhedral such as triangular, rectangular, pentagonal, heptagonal, octagonal, etc. and curvilinear such as circular, oblong, etc.) may also be used for this purpose.

The slanted design and configuration of screen apertures 28*a* serve two significant purposes which are particularly useful in the processing of plastic materials. As previously mentioned, the materials processed within the secondary processing chamber 3 are subjected to centrifugal forces which tend to force the material outwardly and towards discharge spout 8. When these outwardly propelled materials enter the region of grated screen 28, the grated screen apertures 28*a* provide an apertured region for the discharging of material therethrough. The slanted configuration of apertures 28*a* allows the centrifugally propelled materials of a proper size to flow and pass more smoothly through apertures 28*a*. The rearward side of each aperture 28*a* is beveled by the slanted cut so as to form a cutting edge which in turn serves as a shearing edge so that any plastic particles (including oversized particles) impinging onto the cutting edges of apertures 28*a* will undergo successive particle reduction as the material is fed across the face of the grated screen 28. Oversized plastic materials (i.e. those failing to pass through screen 28) are propelled about the outer processing region of the secondary processing chamber for further particle size reduction by the recutter knives and recycled past screen 28 until they are of a size sufficient to pass through the screen.

The size of the apertures may be varied so as to accommodate the desired shredded material particle size. The preferred hexagonal shaped apertures as shown in the Figures measure ¾ inch on each hexagonal side and will typically produce a commercially attractive shredded plastic product.

Figure 10:
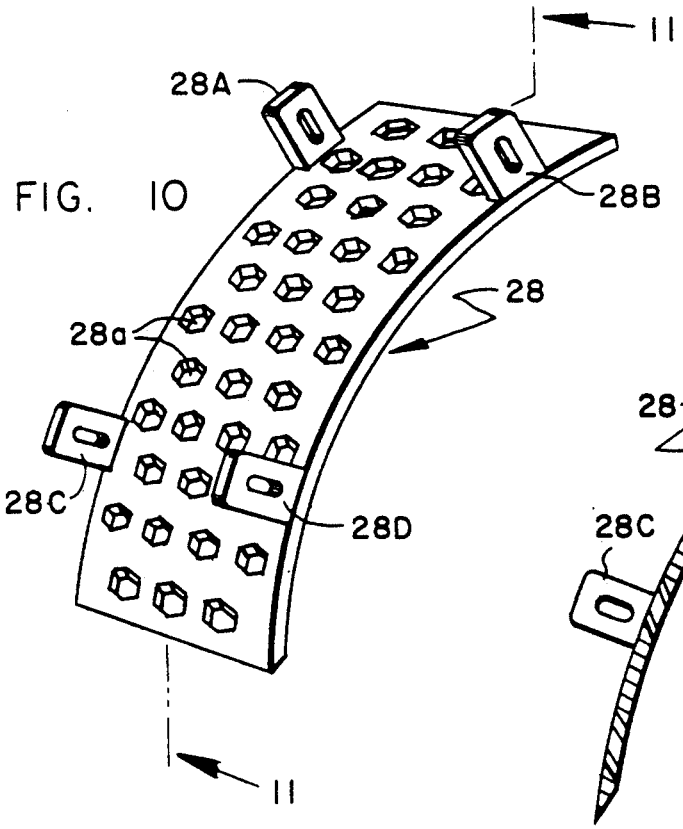
FIG. 10 depicts an enlarged top view of the grated screen shown in FIG. 1.
Figure 11:
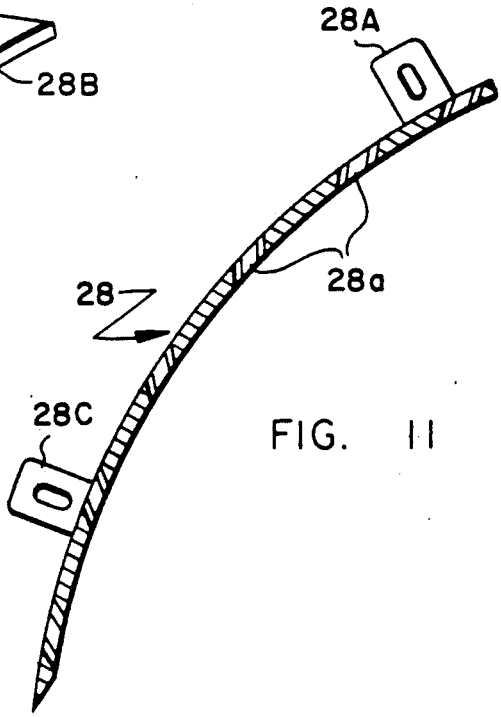
FIG. 11 is a cross-sectional view of the grated screen taken along line 11—11 of FIG. 10.

It may be further observed from FIGS. 10–11 that grated screen 28 (measuring a 90 degree arc about 18 inches along its O.D. curvature and 7 ⅜ inches in width) contains a plurality of apertures 28*a* positioned upon screen 28 so as to uniformly process shredded material which is swept across its face. The depicted screen includes 11 rows of apertures 28*a*. The first row of apertures 28*a* on the material feed size contains three hexagonal apertures 28*a*, the next succeeding row includes four hexagonal apertures 28*a* in an off-set relationship to the apertures 28*a* of the first row with the hexagonal placement of the four apertures 28*a* in each successive row thereafter being placed in a repeating off-set sequence through the last row (i.e. 11th row) of three apertures 28*a*. This creates a linear alignment of apertures 28*a* within each row and a linear alignment between each of the alternating row, and a diagonal aperture 28*a* alignment between successive rows. This particular patterned arrangement has been found to be highly effective when applied to the processing of plastic materials. The material passing through screen 28 is discharged at considerable air blown velocity through discharge spout 8.

Figure 13:
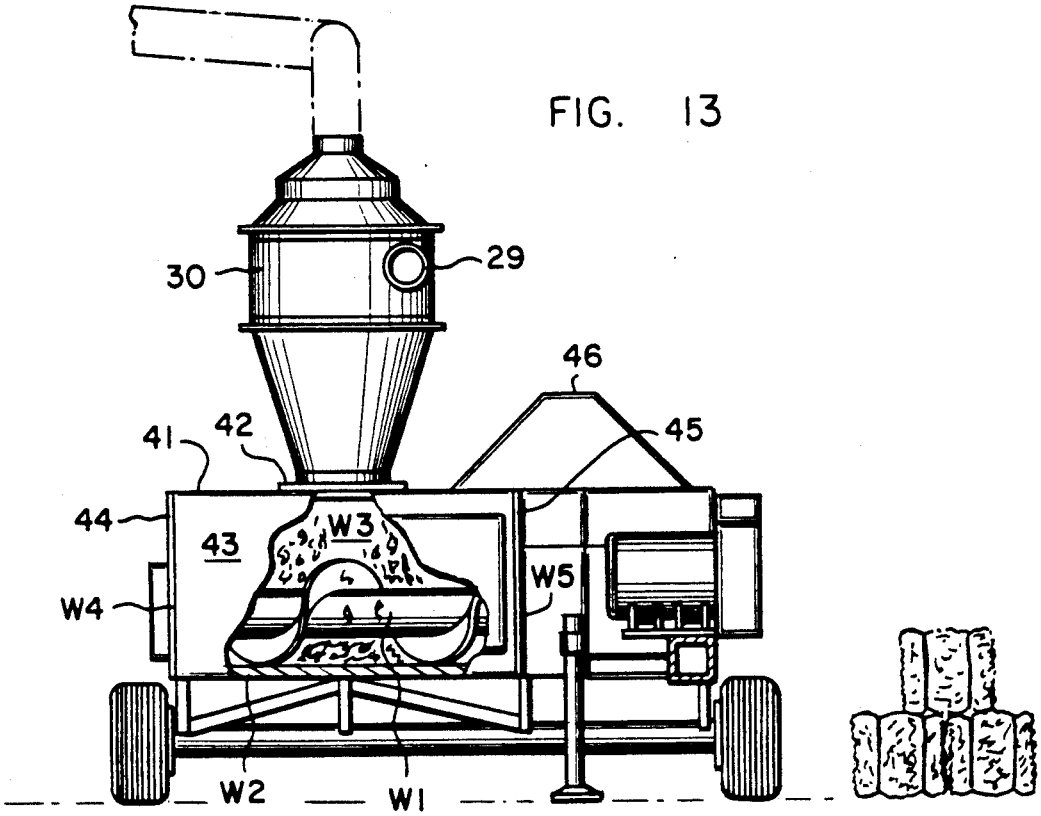
FIG. 13 is a cross-sectional view taken along line 13—13 of FIG. 12 showing in greater detail the enclosed system therefore.
Figure 12:
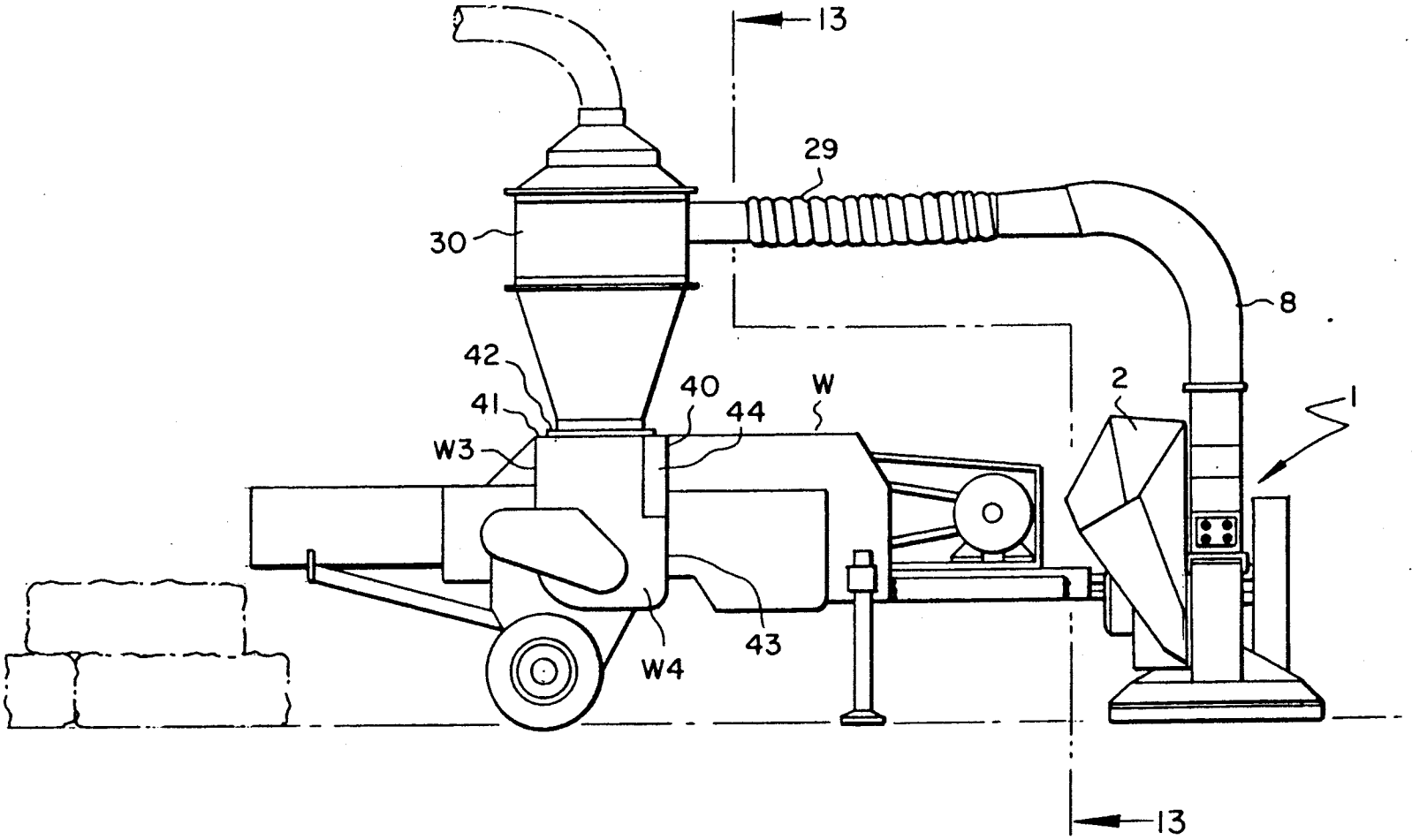
FIG. 12 depicts the device of FIG. 1 in operative association with an agricultural baler equipped with an enclosed system/for transport of processed materials from the device to the baler.

Unsafe health and environmental safety hazards (especially in the case of processed paper product discharges) are prone to arise in the absence of protective measures against such hazards. The present invention provides such protective measures by recovering the discharged process materials under an enclosed system whereby the air borne processed materials are protectively retained within an enclosed system and converted to a baled product form as shown in FIGS. 12 and 13. In order to effectively recover shredded paper products in a transportable, environmentally safe and usable form, it is initially desirable to reduce the material velocity as well as the concomitant velocity of air discharged by the device 1. This may be effectively accomplished by subjecting the discharged material to a cyclone separation treatment. Thus, as may be observed from FIGS. 12–13, the material discharged from spout 8 is conducted through any suitable conduit 29 (such as flexible pipe) to cyclone separator 30 which effectively reduces the amount of air blown wind and material velocity. Other comparable techniques such as blowing the discharged material into a holding compartment or bin may also be used for this purpose. A cyclone separation however is the preferred embodiment of this invention, especially since this affords a particularly advantageous continuous and direct feed source for baling the shredded material into a suitable bale size as well as offering a portable shredding and baling system therefore.

The shredded material discharged from the cyclone 30 is gravity fed onto the feed mechanism of a conventional agriculture baler (generally designated as W). The overall processing of the material commencing with feed to its discharge from chipping device 1, the cyclone treatment thereof and its feeding to the baling device is preferably conducted within an enclosed and continuous processing system. Although this invention may be generally adapted to a broad range of conventional agriculture baling devices which may be enclosed for material feeding, conventional balers equipped with side delivery pick-up and auger feeds, and a baling plunger which compresses or compacts the auger feed materials within a bale forming compartment such as those manufactured by Deere and Company (e.g. John Deere Model Nos. 336, 327, etc. and particularly the currently manufactured Model 328 baler) are particularly well adapted for use herein. This may be accomplished by removing the forage pick-up attachment from such balers and fabricating an enclosing canopy structure about the auger feed mechanism such an enclosed baler feed housing adapter (generally referenced as 40) as shown in FIGS. 12 and 13. The depicted feed housing adapter 40 includes a top panel section 41 fitted with a cyclone feed aperture 42 which allows for gravity feeding of the cycloned material onto the baler feed auger W1, an outer side panel extension section 44, an inner panel extension section 45 and a front panel section 43 equipped with an accessing door 43A in case there is a need to gain access to the auger feed mechanism. The baler feed portion of the depicted baler W generally includes a feed auger W1 for feeding material to baler W, an auger floor panel W2 upon which the material is typically fed onto a rear auger sidewall W3 vertically bridging the aft margin of floor section W2, vertically extending outer sidewall W4 cornering onto the outer margin of the floor W2 and rear sidewall W3 and an inner sidewall W5. The bottom margin of the front panel 43 is tapered inwardly for securance onto the forward margin of floor W2 to facilitate the feeding of the shredded material onto auger W1. The front panel 43 and the top panel 42 (except the rectangular cut-out portion abutting onto the baling arm protective cover 45) may be rectangular in shape. The top panel 42 abuttingly bridges across and onto the baler auger rear panel section W2 and perpendicularly forwardly therefrom to a vertical point slightly forward from the foremost edge of floor panel section W2. The sidewall extension attachments (i.e. 44 and 45) vertically bridging between the partially enclosed baler feed assembly and panel 41 complete the enclosed auger housing attachment for the baler. A packing arm covering member 46 (shown in FIG. 13 as trapezoidal in shape) for covering the baler packing arm (not shown) encloses the environmentally open site of the auger feed and baler plunger mechanism so that the processed shredded papers and similar products may be directly fed and retained within baler 10 until converted to the desired baled end product. Accordingly, a conventional baler with its existing open feed structure can be modified so as to receive (within an entirely enclosed baler feed system and protective canopy) shredded material for baling into agriculture sized bales. Other conventional balers as well as differently shaped housings for enclosing the baler feed mechanism may be also used for this purpose. The agriculture baler otherwise operates in customary manner with the capacity for producing the smaller sized agriculture bales (e.g. less than 150 pounds such as within the adjustable 35–125 pound range).

The invention has been described herein in considerable detail, and primarily with respect to the specifics of a preferred embodiment. However, modifications within the scope of the invention will occur to those skilled in the art. Hence, the invention should not be considered to be confined to the details given in connection with the description of a preferred embodiment, but only as limited by the scope of the appended claims.

What is claimed is:

1. A rotating cutting disc device having the versatility to process aerodynamic buoyant or pliable feed materials in which feed materials are fed to a feed side of a rotating disc fitted with at least one cutting knife and a correspondent adjacent passageway mating onto each knife so as to allow materials cut by the knife to pass through the disc to an opposite side of the disc, said device comprising:

A) a rotating disc which rotates about an axis which disc includes:

a) at least one cutting knife projecting outwardly from the feed side of the disc for cutting feed materials fed thereto, b) a passageway adjacently positioned to each knife which passageway communicates from the feed side to the opposite side of the disc whereby materials cut by the knife pass therethrough into a secondary processing chamber, and c) a channeling member mounted along a distal margin of the passageway on the feed side of the disc for directionally channeling the feed materials onto the knife and the passageway; and B) a discharge outlet for discharging processed materials from the device.

2. The device according to claim 1 wherein said disc includes a plurality of cutting knives which respectively register onto an adjacently disposed passageway.

3. The device according to claim 2 wherein in relation to the rotation of said disc about said axis, said passageway forms an elongated passageway contouring onto said disc along a forward margin, a rearward margin, a proximate margin bridging between said forward margin and said rearward margin and a distal margin which bridges between said rearward margin and said forward margin at a radially outwardly disposed position from said proximate margin.

4. The device according to claim 3 wherein said knives respectively incline outwardly from a site aligned along a rearward margin of said passageway so that said knives create an open zone along the distal margin and said channeling member forms an enclosing barrier of the open zone along the distal margin of said passageway.

5. The device according to claim 4 wherein the knives respectively include a distal edge laterally aligned along the distal margin of said passageway and said channeling member abuttingly engages onto the distal edge of said knives.

6. The device according to claim 5 wherein the channeling member comprises a plurality of channeling members respectively mounted onto said disc in an abutting relationship to the respective distal edge of said knives and the respective distal margin of said passageway.

7. The device according to claim 6 wherein the channel members are abuttingly aligned onto a distal edge of said knives and project sufficiently forward of said knives so as to effectively sweep the feed materials onto said knives and through said passageway.

8. The device according to claim 5 wherein said knives have a forwardly projecting cutting edge which corners onto said distal edge and the channeling member includes a leading portion tapering downwardly on the feed side of the disc to a position forward to the cutting edge of said knives.

9. The device according to claim 8 wherein the channeling member comprises a wedge-shaped member characterized as having a substantially flat surface interfacially mounted onto the disc and a multiple ramped surface opposite from said flat surface wherein the ramped surface declines downwardly towards the disc to a terminating position forward from the cutting edge of said knives and the ramped surface abuttingly engages onto the distal edge of said knives.

10. The device according to claim 5 wherein the channeling member includes an inner ramped portion of a sufficient ramped inclination to permit a stationary anvil of the device to clear said inner portion and an outer multiple ramped portion comprised of a rear ramped section of a registering inclination so as to allow the distal edge of said knives to abuttingly engage thereupon and forward ramped section of a steeper ramped inclination than said rear ramped section with said forward ramped section and said rearward ramped section forming a stepped incline cornering onto said cutting edge and said distal edge.

11. The device according to claim 1 wherein the disc includes a peripheral rim projecting inwardly on the feed side of the disc and the channel member is mounted onto the feed side of the disc so as to form a channeling bridge between said passageway and the rim.

12. The device according to claim 1 wherein the passageway comprises an elongated passageway characterized as having in relation to the direction of rotation of said disc about said axis, a forward margin, a rearward margin disposed at a rearward and lateral position in relation to said forward margin, a distal margin disposed between said rearward margin and said forward margin which radially defines the outermost boundary of said passageway and a proximate margin laterally opposite from said distal margin and disposed between the forward margin and rearward margin.

13. The device according to claim 12 wherein in relation to the feed side of the disc, the knives are respectively aligned so as to form an acute angle therebetween vectored in substantial proximity to the rearward margin and extend forwardly and outwardly therefrom so as to respectively form in relationship to said knives and the feed side of the disc an open zone about the forward margin, the distal margin and proximate margin of said passageway.

14. The device according to claim 13 wherein the channeling member is mounted to the disc along the distal margin of the passageway with said channeling member being of a sufficient size and configuration so as to form a closure to the open zone about the distal edge of said knives and the distal margin, and said channeling member is further characterized as having an outwardly tapered configuration which extends sufficiently forwardly from said distal margin and a cutting edge of said knives so as to cause the materials about an outer peripheral zone of the feed side of the disc to be directionally channeled towards the respective knives and passage through the adjacent passageway thereto.

15. The device according to claim 14 wherein the device includes an inner channeling member of a sufficient size and configuration so as to form a closure to the open zone about the proximate margin of the passageway.

16. The device according to claim 1 wherein the device includes a removable screen having apertures of a predetermined screen size positioned at the discharge outlet.

17. The device according to claim 1 wherein the discharge outlet is operationally associated with a cyclone separator and an enclosed conduit connecting the separator to said discharge outlet.

18. The device according to claim 1 wherein the device is operationally associated with an agricultural baler fitted with a baling plunger and a baling compartment for continuously baling of the discharged processed materials into a baled product and includes means confined within an enclosed material handling system for continuously feeding the processed materials discharged from the device to said plunger and said baling compartment.

19. The device according to claim 18 wherein the agricultural baler is equipped with an auger feed for feeding materials to the plunger and an enclosing canopy about said auger feed and said plunger so as to entrappingly retain the processed materials fed to said auger feed.

20. The device according to claim 19 wherein prior to the feeding of processed materials to the auger feed there is included within the enclosed material handling conduit system, a means for reducing the velocity of the processed materials.

21. The device according to claim 20 wherein the means for reducing the velocity includes a material exhaust for gravity feeding of materials exhausted therefrom into the enclosing canopy.

* * * * *